US009745969B2

(12) United States Patent
Viehe

(10) Patent No.: US 9,745,969 B2
(45) Date of Patent: Aug. 29, 2017

(54) LID-PUMP ASSEMBLY

(71) Applicant: Matthew F. Viehe, Sheridan, IN (US)

(72) Inventor: Matthew F. Viehe, Sheridan, IN (US)

( * ) Notice: Subject to any disclaimer, the term of this patent is extended or adjusted under 35 U.S.C. 154(b) by 0 days.

(21) Appl. No.: 14/886,680

(22) Filed: Oct. 19, 2015

(65) Prior Publication Data

US 2016/0136669 A1 May 19, 2016

Related U.S. Application Data

(60) Provisional application No. 62/065,895, filed on Oct. 20, 2014.

(51) Int. Cl.

| | |
|---|---|
| ***B05B 11/00*** | (2006.01) |
| ***B65D 53/02*** | (2006.01) |
| ***F04B 9/14*** | (2006.01) |
| ***F04B 23/02*** | (2006.01) |
| *B05B 9/043* | (2006.01) |
| *B05B 9/08* | (2006.01) |

(52) U.S. Cl.

CPC ..... *F04B 9/14* (2013.01); *F04B 23/028* (2013.01); *B05B 9/043* (2013.01); *B05B 9/085* (2013.01); *B05B 11/3047* (2013.01); *B65D 53/02* (2013.01)

(58) Field of Classification Search

CPC ..... B05B 9/043; B05B 9/085; B05B 11/3047; B65D 53/02; F04B 9/14; F04B 23/028

See application file for complete search history.

(56) References Cited

U.S. PATENT DOCUMENTS 1,691,374 A * 11/1928 Birkenmaier ..... B05B 7/2494 220/86.1
2,665,663 A * 1/1954 Rawson ..... A01J 5/04 119/14.4
2,939,603 A * 6/1960 Young ..... B65D 21/0223 206/508
3,106,320 A * 10/1963 Campbell ..... F16N 13/08 222/318
4,094,433 A * 6/1978 Numbers ..... B65D 47/249 220/254.5
4,278,132 A * 7/1981 Hostetter ..... A62C 5/00 137/897
4,422,788 A * 12/1983 Braithwaite ..... B05C 17/0316 222/1
4,432,285 A * 2/1984 Boyars ..... B65F 1/02 109/1 R
4,588,110 A * 5/1986 Nelson ..... B05B 7/24 222/135
4,722,733 A * 2/1988 Howson ..... A61J 1/2096 141/330
4,938,376 A * 7/1990 Fieseler ..... F16J 15/021 220/203.12
5,046,634 A * 9/1991 McFarlin ..... B65D 77/06 220/495.05
5,050,707 A * 9/1991 Wilhelmsen ..... F16N 7/12 184/64

(Continued)

*Primary Examiner* — Frederick C Nicolas
(74) *Attorney, Agent, or Firm* — Kevin R. Erdman; Brannon Sowers & Cracraft PC

(57) ABSTRACT

The present invention involves a combination bucket lid and pump apparatus for pumping fluids out of a bucket having an open end, the pump mounted on the bucket lid, and the bucket lid extending over the open end of the bucket and having a circumferential clamp for clamping onto the bucket exterior and sealing the open end.

19 Claims, 7 Drawing Sheets

(56) References Cited

U.S. PATENT DOCUMENTS

| | | | | | |
|---|---|---|---|---|---|
| 5,154,308 | A * | 10/1992 | Larson | B65D 77/06 | 220/288 |
| 5,240,144 | A * | 8/1993 | Feldman | B67D 1/0001 | 222/105 |
| 5,375,746 | A * | 12/1994 | Schaefer | B67D 7/0205 | 222/383.1 |
| 5,479,955 | A * | 1/1996 | Roodvoets | B65B 55/022 | 137/15.16 |
| 5,673,818 | A * | 10/1997 | Kaneski | B67D 7/0277 | 222/105 |
| 5,887,750 | A * | 3/1999 | Popp | B02C 19/0093 | 220/378 |
| 6,264,054 | B1 * | 7/2001 | Miyake | B65D 81/2038 | 220/23.83 |
| 6,499,898 | B1 * | 12/2002 | Garcia | B05B 11/0005 | 222/383.3 |
| 6,595,392 | B2 * | 7/2003 | Barnett | B05B 9/0816 | 222/105 |
| 6,701,975 | B1 * | 3/2004 | Neal | B05B 9/03 | 141/18 |
| 6,953,133 | B2 * | 10/2005 | Englhard | B05B 9/0877 | 222/385 |
| 7,513,444 | B1 * | 4/2009 | Kurimski | E04D 15/07 | 215/286 |
| 7,723,701 | B1 * | 5/2010 | Walck | B01L 3/508 | 220/8 |

* cited by examiner

LID-PUMP ASSEMBLY

CROSS REFERENCE TO RELATED APPLICATIONS

This application is related to and claims priority to U.S. Provisional Patent Application no. 62/065,895 filed on Oct. 20, 2014 which is incorporated herein by reference.

BACKGROUND OF THE INVENTION

Field of the Invention

The field of the invention relates to standardized buckets and pumps used to evacuate such buckets.

Description of the Related Art

A variety of oils, lubricants, fertilizers, paints, stains, and other industrial fluids are solid in standardized five gallon pails or buckets. The advantages of such containers are reduced cost for bulk purchase, reduced packaging, and fewer trips to purchase additional supplies. A major disadvantage of five gallon buckets is that they are heavier and more difficult to handle and dispense fluid from than smaller containers. One way of increasing the ease of dispensing from five gallon buckets is by using a lid-type pump assembly, but existing pump assemblies have several drawbacks.

The typical existing bucket pump assembly 10 as shown in FIG. 1 is designed from a lid of thin sheet steel 12, to fit over the rim of any five gallon bucket 14 (shown in outline for clarity), or any container of similar size, and typically held on loosely with small thumbscrews 16, with no sealing mechanism. Without a means for sealing the lid 12 to the top of the bucket 14, the assembly will leak as soon as the bucket it tipped over (a common occurrence when such buckets are commonly transported in the backs of trucks and other vehicles).

In many cases, the existing bucket pump utilizes a flexible hose 18 with a bent tube on the end of the hose for dispensing pumped fluid. The tube is typically stored in a hole 20 in the lid 12 so as to allow any fluid remaining in the hose or tube to drain back into the bucket. This hole 20 allows for contamination of the fluid by dust, dirt, other fluids (e.g., rain), or similar materials from the environment. Additionally, fluid can leak from the hole if the bucket is tipped over. Such contamination can lead to the waste of remaining fluid which must be disposed of if sufficiently contaminated and/or to the contamination and damage of expensive equipment if the fluid is actually used in an engine, transmission, and the like.

The assembly further includes a pump 22 which is typically a separate unit which is held to an opening in the lid by a clamping ring 24. The clamping ring includes a gap to allow the pump to slide and to be placed of the base of the bucket, but this gap can act as another point of entry for contaminants into the bucket and/or as a source of leaks. The gap is often the result of loose manufacturer tolerances to allow clamping action on the pump.

SUMMARY OF THE INVENTION

The present invention relates to is an improved lid-pump assembly which reduces the possibility of leakage, limits contamination of the fluid contained in the bucket, and enhances the ability to dispense fluid from a bucket.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
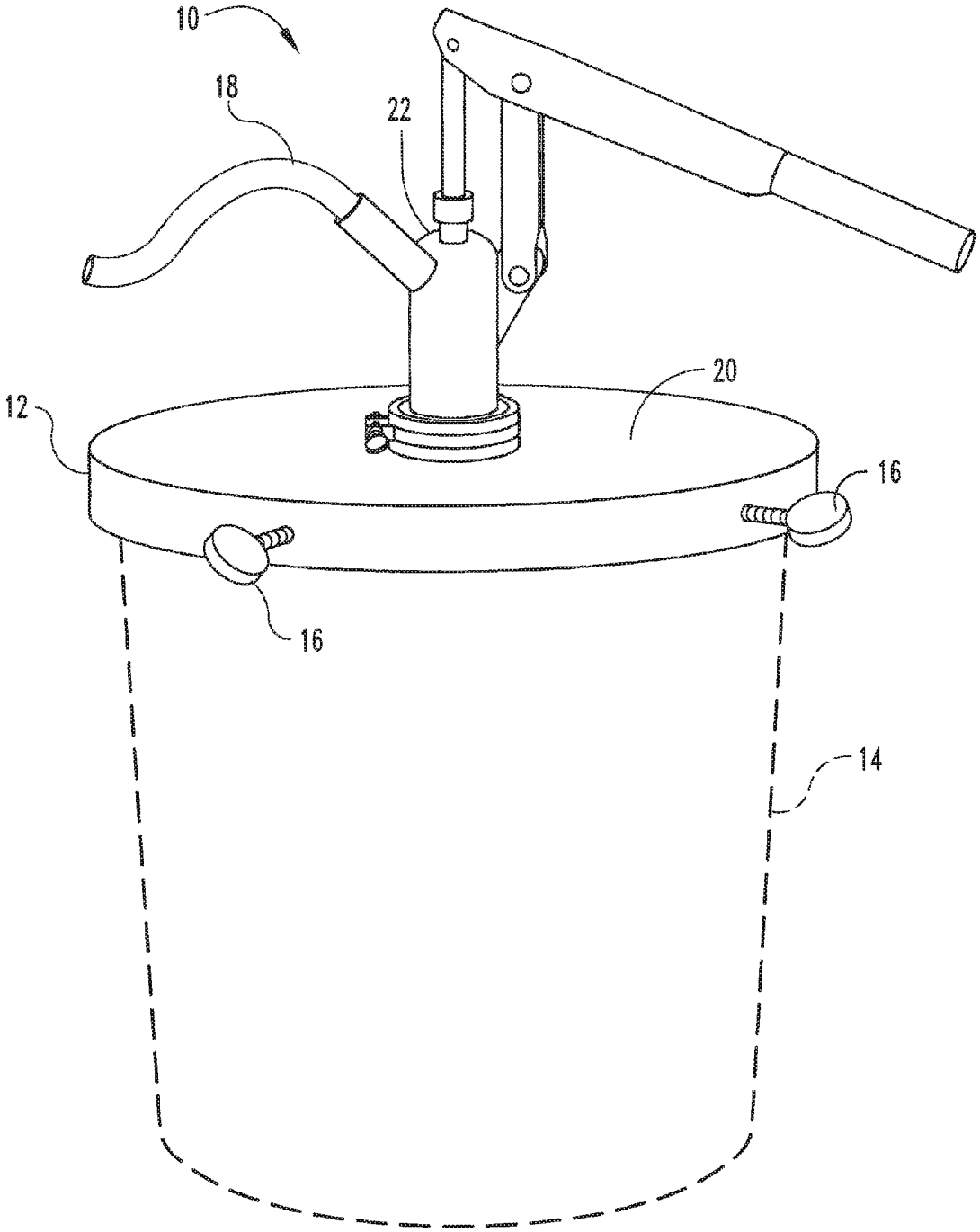
Fig. 1 (Prior Art)
FIG. 1 is a side perspective view of a prior art lid pump assembly.
Figure 2:
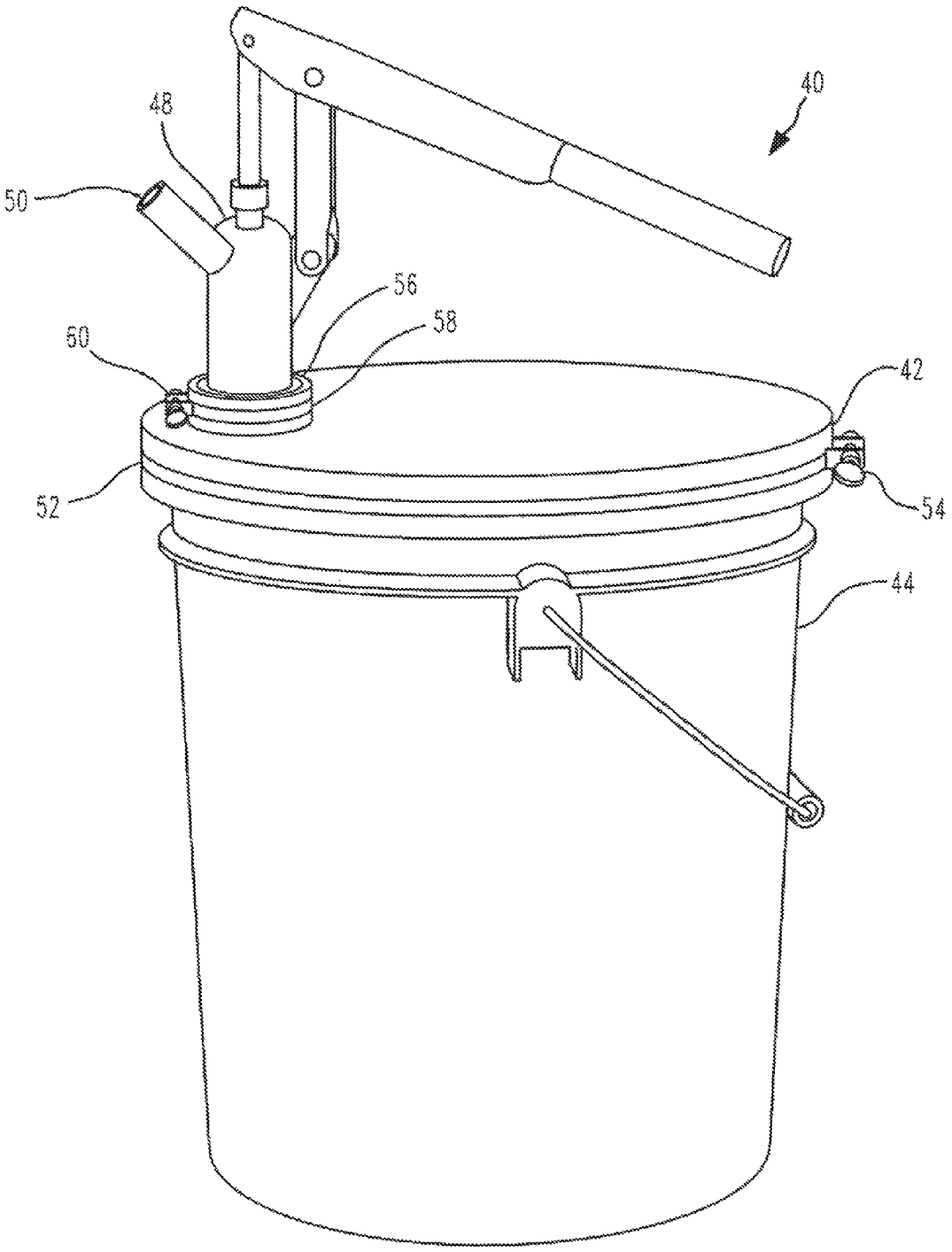
FIG. 2 is a side perspective view of a lid pump assembly according to one example of the disclosed invention.
Figure 3:
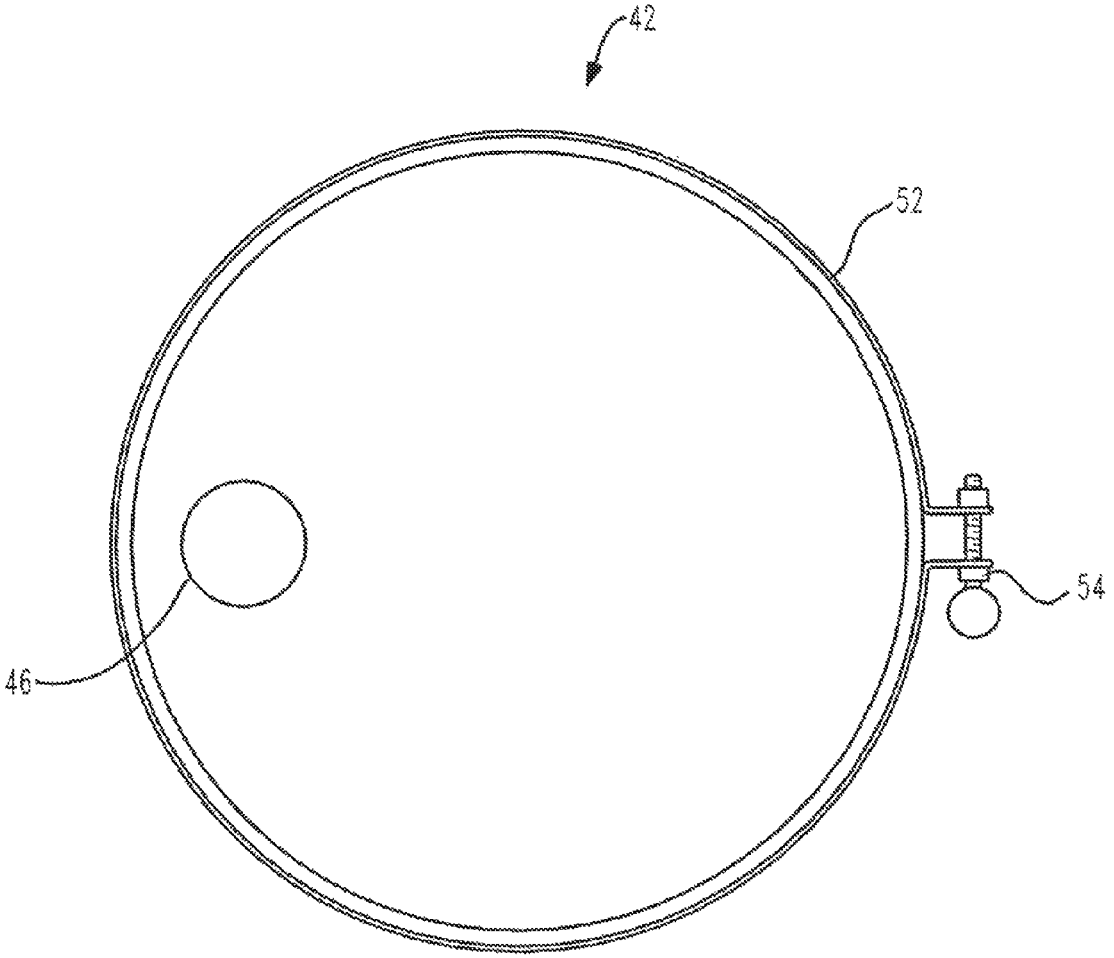
FIG. 3 is a top plan view of a bucket lid according to the example of the disclosed invention shown in FIG. 2.
Figure 4:
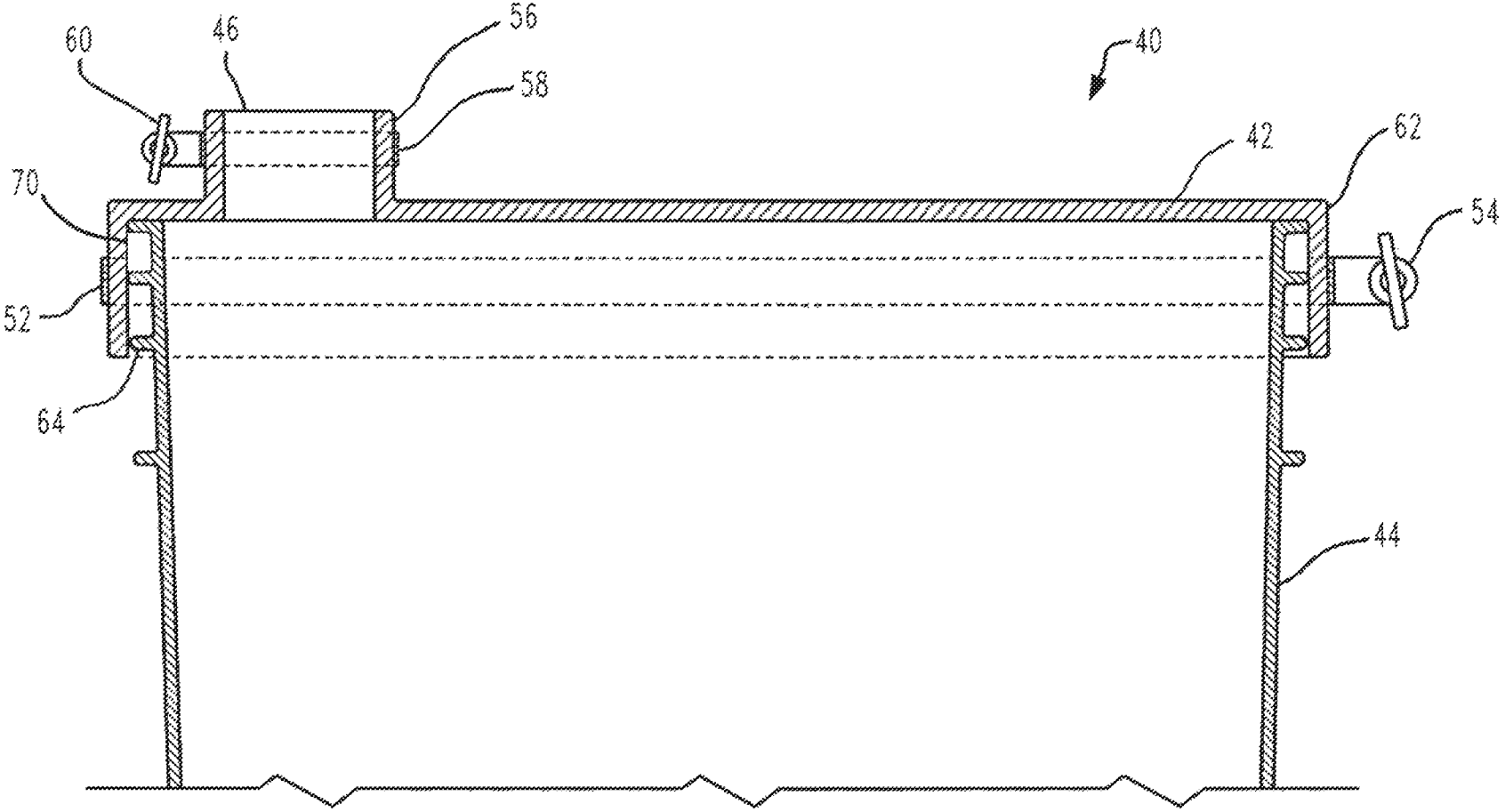
FIG. 4 is a cut away view of the lid according to the example of the disclosed invention shown in FIG. 2.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates an embodiment of the invention, in one form, and such exemplifications are not to be construed as limiting the scope of the invention in any manner.

DESCRIPTION OF EMBODIMENTS OF THE PRESENT INVENTION

The embodiments disclosed below is/are not intended to be exhaustive or limit the invention to the precise form disclosed in the following detailed description. Rather, the embodiment is chosen and described so that others skilled in the art may utilize its teachings.

The disclosed invention relates to a lid-pump assembly for a bucket or other storage container with improved protection against spillage and contamination of the bucket contents.

In one example of the disclosed invention a pump seals around the rim of a bucket using a clamp ring to prevent leakage in the event of tipping. This clamp ring is positioned exterior of the rim, and the whole of the diameter of the lid, so any gap as is required by the clamp will not be an entry point of contaminants. The clamp ring presses through the cover on a flat seal and onto the rim of the bucket. Optionally, the lid includes a one way or check valve to allow air to enter the bucket as oil or other fluid is pumped out of the bucket but to prevent air entering at other times and/or prevent fluid from escaping the bucket.

Alternately, the side of the lid may be lengthened to provide a seal on the flat part of the bucket. The pump is made to fix in the lid by a clamp that does not allow a gap on the exterior of the lid, and through precision molding of the lid to fit the pump. There may be a precision molded receiver on the upper end (exterior) with a clamp and o-ring or other gasket, and an internal sturdy clamp in the lower end (interior of the bucket). The interface between the lid and the pump may be further enhanced by a separate, more flexible cover that clamps on the pump body itself and comes down over the lid to shed contaminants from this area.

The end of the dispenser tube may include a robust cap that easily attaches and detaches, using a pin or ball detent system. This cap may be integrated into the lid, for the purpose of relieving pressure back into the bucket if the pump is operated with the cap on. The integrated cap then has an insert to seal the cap when the tube is in use or not capped. The dispenser tube clamps on to the lid by way of molded fittings to accept the tube for secure storage and transport. The pump is offset from the centerline of the lid and bucket to allow the bucket handle to still be used for transport and carry of the bucket and pump assembly, and to allow for more complete emptying of the product by slight tipping to the side, which is a shortcoming not mentioned above, due to the pump being in the center of the lid. The lid optionally has a series of attachment points (to accommodate rope, tarp straps, or the like) molded into it to prevent tipping during transport.

In another example, assembly 40 includes lid 42 suitably sized and configured to fit on a standard sized five gallon bucket 44. In other examples, lid 42 may be sized and configured to fit on different sized containers as desired. Lid 42 includes a mounting point such as opening 46 to which separate pump unit 48 may be removably mounted. The pump includes dispensing tube 50 to which a flexible hose or tube (not shown in this illustrative example) may be mounted. The size and length of the hose may vary according to a particular application as may any optional attachments such as various nozzles, tips, triggers, fasteners, and the like. Lid 42 is removably secured to bucket 44 by a securing member shown in this example as a ring clamp 52. In other examples, more than one ring clamp may be used. In this particular example, ring clamp 52 is held in place by screw-type fastener 54. In other examples, ring clamp 52 may be held in place by a bolt, a pin, a spring clamp, latch, or other suitable securing means.

Opening 46 in lid 42 is defined by raised portion 56 to which the base of pump 48 is mounted by sliding the base of the pump over the raised portion. Pump 48 is secured to lid 42 by ring clamp 58 similar to ring clamp 52 which secures lid 42 to bucket 44. In this particular example, ring clamp 58 is held in place by screw-type fastener 60. In other examples, the ring clamp may be held in place by a bolt, a pin, a spring clamp, latch, or other suitable securing means.

Lid 42 further includes lip portion 62 which extends over the top of bucket 44 so as to allow the lid to be clamped to the bucket. Some buckets may include one or more ridges or ribs 64 near the top of the bucket to aid in securing the lid to the bucket. In some embodiments, the lip portion further includes at least one gasket 70 as additional protection against spillage of fluids from the bucket. Optionally, one or more gaskets are sized and configured to fill the gap between any ridge portions. The gasket may be made of suitable material such as rubber, cork, plastic, and the like depending on the fluid being stored in the bucket. In other embodiments, the raised portion of the bucket lid and/or the base of the pump may also include a gasket made of a suitable material.

In this particular example, ring clamp 52 is held in place by screw-type fastener 54. In other examples, the ring clamp may be held in place by a bolt, a pin, a spring clamp, latch, or other suitable securing means. In still other embodiments, the lid may further include a one way vent lock which would allow air to enter the bucket through the lid during the pumping operation so as to prevent the buildup of negative pressure within the bucket. In some embodiments, the vent lock may include a filter so as to prevent contamination of the fluid inside the bucket.

Figure 5:
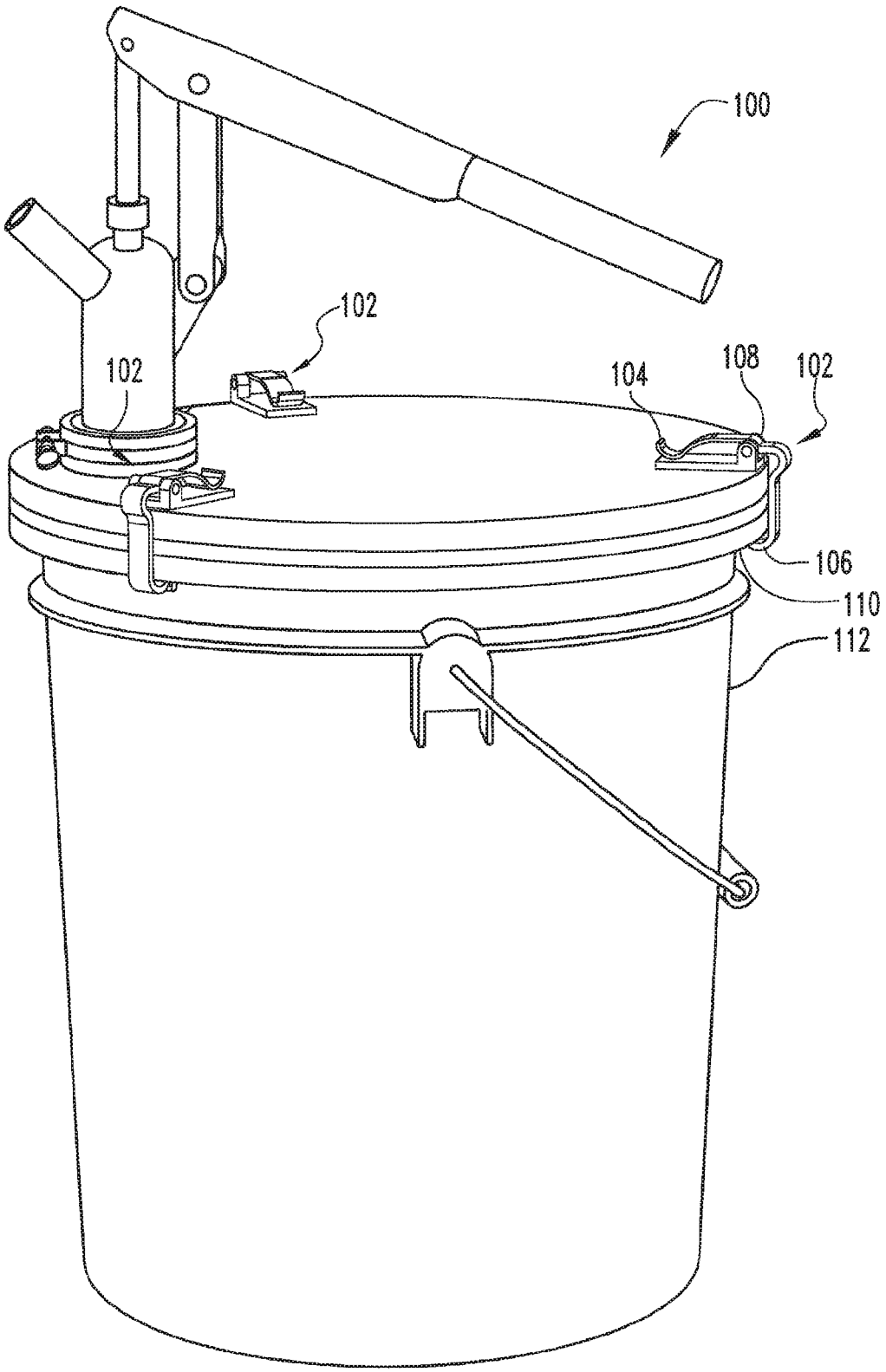
FIG. 5 is an alternate example of the disclosed invention.
Figure 6:
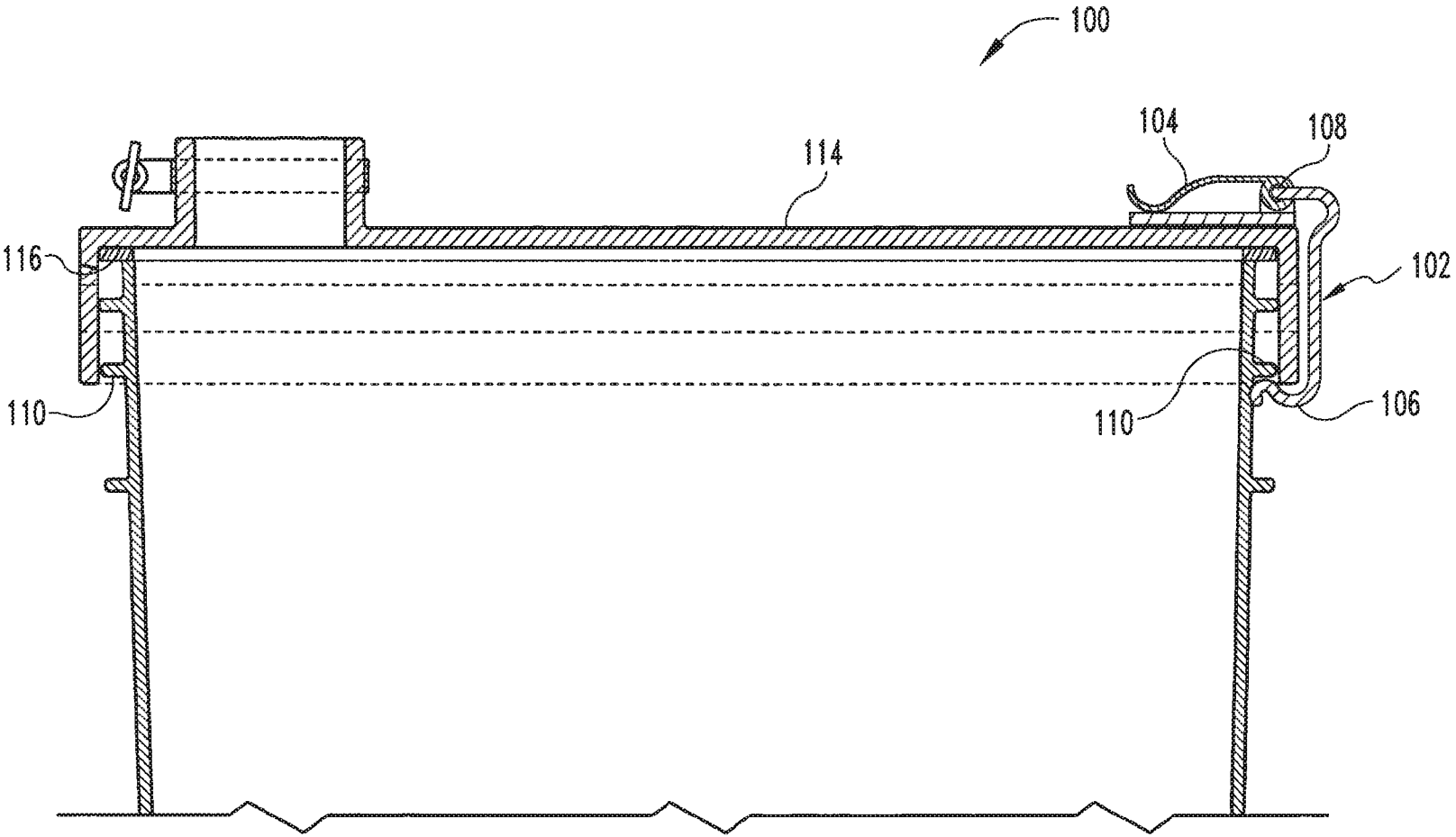
FIG. 6 is a cut away view of the lid according to the example of the disclosed invention shown in FIG. 5.

In an alternate embodiment 100 shown in FIGS. 5-6, the ring clamp of the previous embodiment has been replaced by one or more latches. In this particular example, the latches 102 comprise a handle portion 104, a latch portion 106, and a hinge portion 108. The hinge portion 108 allows the latch 102 to be movable between a locked position (shown) and an unlocked position (not shown). In the locked position, the handle portion 104 is depressed against the lid 114 which urges the latch portion 106 upward so as to engage the rim 110 of the bucket 112. In the unlocked position, when the handle portion 104 is raised (i.e., lifted up and away from the lid) the latch portion 106 is lowered relative to the lid 114 and able to swing free of the rim 110 of the bucket 112 so as to allow removal of the lid 114. Optionally, a gasket 116 made from a suitable material is included to improve the seal between the lid 114 and the bucket 112. In other embodiments, the length of the latch portion of the latches is adjustable (such as by a threaded adjustment) so as to allow for securing the lid to buckets of differing heights and/or configurations. Typically the latch portion is mounted to the lid so that when the bucket is empty the lid may be placed on a new bucket without risk of accidentally losing the latches. In other embodiments, the latches are not mounted to the lid portion and may be completely removed from both the lid and the bucket when not in use.

Figure 7:
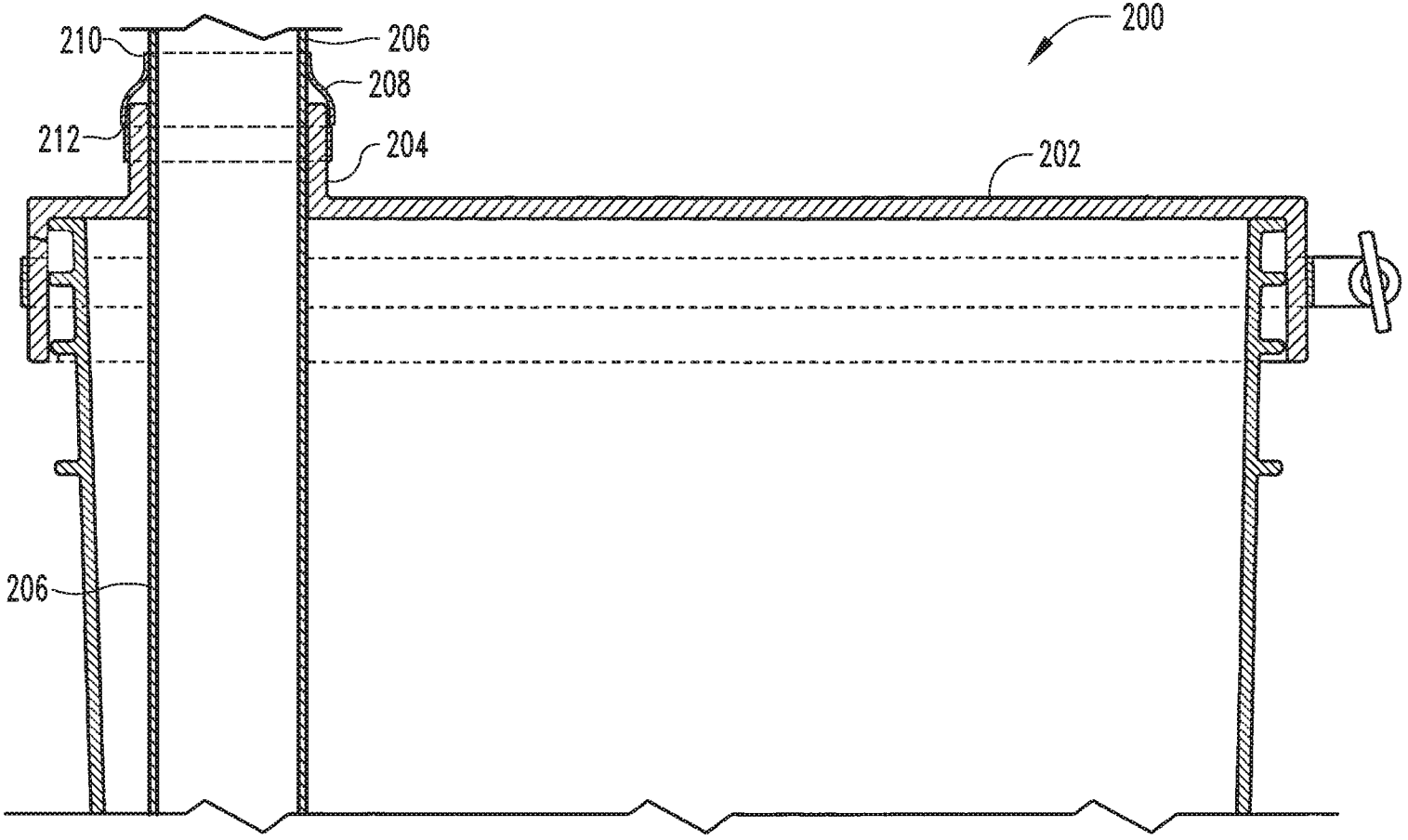
FIG. 7 is a cut away view of a lid according to another example of the disclosed invention.

FIG. 7 shows a cut away cross sectional view of a lid assembly 200 another embodiment of the disclosed invention. In this example, the lid 202 includes an opening defined by a raised portion 204 to which the base 206 of a pump is mounted by sliding the base 206 of the pump through the raised portion 204. A protective membrane 208 is disposed around the base 206 of the pump and is sized so as to cover the interface of the pump base 206 and the bucket lid raised portion 204 to prevent contaminants from entering the bucket. The membrane 208 may be made from rubber, plastic, or any other suitable material depending on the bucket contents. In this example, the membrane is a generally ring shaped member having an inner diameter opening 210 sized so as to allow the pump base 206 to slide therethrough and an outer diameter 212 sized so that the membrane is large enough to cover the interface of the pump based and the raised portion of the lid. The membrane may be made of a flexible material so as to allow the outer diameter to be flipped downward to protect the interface and upward to allow access to the interface.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A bucket lid-pump assembly for mounting to a bucket, comprising:

a lid having lip portion with an inner diameter sized to securedly fit over a bucket opening;

a gasket disposed between the inner diameter of the lip portion and the bucket opening;

at least one ring clamp disposed about the lip portion which is adjacent to the gasket, securing the lid to the bucket opening; and a pump mounted to the lid by a clamping member;

wherein tightening the at least one ring clamp compresses the lip portion directly into the gasket.

2. The bucket lid-pump assembly of claim 1, wherein the ring clamp is secured using a screw member.

3. The bucket lid-pump assembly of claim 1, further comprising a gasket member disposed between the pump and the lid.

4. The bucket lid-pump assembly of claim 1, wherein the clamping member is a ring clamp.

5. The bucket lid-pump assembly of claim 1, further comprising a check valve mounted to the lid.

6. A bucket lid and pump apparatus for pumping fluids out of a bucket, comprising:

a lid portion having a mounting position for a pump and a lip portion with an inner diameter sized to securedly fit over a bucket opening;

a pump removably mounted to the lid mounting position and secured by a clamp;

at least one gasket disposed between the inner diameter of the lip portion and the bucket opening; and at least one ring clamp disposed about the lip portion which directly contacts the at least one gasket, securing and sealing the lid to the bucket opening.

7. The bucket lid-pump assembly of claim 6, wherein the ring clamp is secured using a screw member.

8. The bucket lid-pump assembly of claim 6, further comprising a gasket member disposed between the pump and the lid mounting position.

9. The bucket lid-pump assembly of claim 6, further comprising a protective membrane disposed so as to cover the lid mounting position between the pump and the lid.

10. The bucket lid-pump assembly of claim 6, wherein the ring clamp is secured using a screw member.

11. The bucket lid-pump assembly of claim 6, wherein the clamp is a ring clamp.

12. The bucket lid-pump assembly of claim 6, further comprising a check valve mounted to the lid portion.

13. A lid-pump assembly for a bucket, comprising:

a lid portion having a mounting position for a pump and a lip portion with an inner diameter sized and configured to securely fit over a bucket;

at least one gasket disposed between the lip portion of the lid and the bucket;

at least one ring clamp disposed about the lip portion securing the lid to the bucket and directly compressing the gasket between the lip portion and the bucket; and a pump removably mounted to the lid mounting position and secured by a clamp.

14. The lid-pump assembly of claim 13, wherein the ring clamp is secured using a screw member.

15. The lid-pump assembly of claim 13, further comprising a gasket member disposed between the pump and the lid mounting position.

16. The lid-pump assembly of claim 13, further comprising a protective membrane disposed so as to cover the lid mounting position between the pump and the lid.

17. The lid-pump assembly of claim 13, wherein the ring clamp is secured using a screw member.

18. The bucket lid-pump assembly of claim 13, wherein the clamp is a ring clamp.

19. The bucket lid-pump assembly of claim 13, further comprising a check valve mounted to the lid portion.

* * * * *